US006875106B2

(12) United States Patent
Weiss et al.

(10) Patent No.: US 6,875,106 B2
(45) Date of Patent: Apr. 5, 2005

(54) GAMING DEVICE AND METHOD

(75) Inventors: Lawrence Weiss, Las Vegas, NV (US); Steven A. Weiss, Las Vegas, NV (US); Jay Stone, Las Vegas, NV (US); Kim Tempest, Las Vegas, NV (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 0 days.

(21) Appl. No.: 09/967,745

(22) Filed: Sep. 28, 2001

(65) Prior Publication Data

US 2003/0032470 A1 Feb. 13, 2003

Related U.S. Application Data

(63) Continuation-in-part of application No. 09/757,915, filed on Jan. 10, 2001.

(51) Int. Cl.[7] ..... A63F 9/24
(52) U.S. Cl. ..... 463/20; 273/138.1
(58) Field of Search ..... 463/9, 13, 16–22, 463/25, 30–31, 37; 273/269, 138.1, 138.2, 143 R

(56) References Cited

U.S. PATENT DOCUMENTS 5,393,057 A * 2/1995 Marnell, II ..... 463/13
5,704,835 A 1/1998 Dietz, II
5,935,002 A * 8/1999 Falciglia ..... 463/19
5,997,401 A 12/1999 Crawford
6,095,921 A * 8/2000 Walker et al. ..... 463/20
6,135,884 A * 10/2000 Hedrick et al. ..... 463/20
2002/0019254 A1 * 2/2002 Ainsworth ..... 463/16

FOREIGN PATENT DOCUMENTS

JP 06-238033 * 8/1994 ..... A63F/5/04

* cited by examiner

*Primary Examiner*—Kim Nguyen
(74) *Attorney, Agent, or Firm*—Bernhard Kreten & Assoc.

(57) ABSTRACT

A method and apparatus for a gaming device in which a player is awarded outright for a winning combination and is eligible for a reward if the displayed outcome can be manipulated by the gaming device to produce a winning combination. A special bar symbol can be coupled with a certain bar subset of the universe of symbols to initiate a further award, perhaps coupled with a multiplier. Preferably, a bonus is provided which includes overlapping exhibitors such as wheels having a sector defining the overlap indicating a bonus element which is placed on an array. A series of elements on the array, when forming a pattern which is recognized by the game results in added credits.

7 Claims, 6 Drawing Sheets

GAMING DEVICE AND METHOD

CROSS REFERENCE TO RELATED APPLICATION

This is a continuation in part of Ser. No. 09/757,915, filed Jan. 10, 2001.

FIELD OF THE INVENTION

The following invention is generally related to instrumentalities and methodologies in gaming devices. More specifically, the instant invention is directed to a gaming device having a winning outcome where the player wins directly and a non-winning outcome which may be modified by the gaming device to produce a winning outcome. The invention transforms a non-winning outcome into a winning outcome if a permutation of the displayed symbols would produce a winning outcome according to a rule set. Most specifically, the following invention allows a gaming device to transform an initial non-winning outcome into a winning outcome by changing the location of one of more displayed symbols. In addition or alternately, at least one designated symbol has a special beneficial effect as to a subset of the total symbols available. A bonus round may also be enabled upon certain conditions in which an array, preferably formed of rows and columns defines an RXC array. The array is completed to provide a bonus according to a rule set by means of two moving wheels having an overlapping sector which correlates to locations on the array, one location at a time to "fill in" or complete the array.

BACKGROUND OF THE INVENTION

One problem common to all gaming machines is the frustration experienced by a player who is unable to achieve a winning combination, yet sees a "near miss" combination that shows a winning combination was just missed. For example, two symbols on a line match, but a third matching symbol is one position off. Players may be superstitious and seek a "hot" machine because players want to believe that their machine is about to pay off. While successive "near miss" results retain the player's interest by encouraging this belief, if the player continues to lose in this situation, interest in the game is not retained and the player leaves the machine and stops gaming.

Several games have been developed that allow displayed symbols to change positions in a limited manner, giving the player another chance to win. These methods are capable of producing more winning combinations for the player, and thus may retain the player's interest more than traditional machines would. However, these changes in orientation are limited in the ways symbols may move and the changes are not guaranteed to produce winning results. In the end, these machines may be less popular with some players because the supposed "second chance" gives them little advantage over traditional methods.

A traditional reel slot has a single payline for three reels with twenty-two physical stops on each reel. A typical game play consists of spinning the reels and stopping the reels to indicate a winning or losing position. Some games in the industry have special "nudge" symbols that have an indicator pointing up or down. When a nudge symbol pointing down lands above the payline, the symbol automatically moves down. When a nudge symbol pointing up lands below the payline, the symbol automatically moves up.

In these nudge games, only particular symbols can nudge. Usually the symbols have an up or down indicator, but sometimes a symbol can nudge both up and down. In all cases, the nudge symbols always nudge, whether a winning combination is made or lost by nudging.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| U.S. PAT. NO. | ISSUE DATE | INVENTOR |
|---|---|---|
| 5,704,835 | Jan. 6, 1998 | Dietz |
| 5,997,401 | Dec. 7, 1999 | Crawford |

SUMMARY OF THE INVENTION

The present invention is distinguishable over the prior art in a multiplicity of ways. For example, the instant invention provides a method and apparatus to transform certain non-winning outcomes into winning outcomes without further effort on the part of the player. This effectively provides the player with a greater opportunity of winning the game. The game preferably transforms the first outcome only if the second outcome provides a payout.

In addition, the present invention preferably transforms the initial outcome only when a winning outcome can be achieved based on a defined rule set. If an initial non-winning outcome cannot be transformed into a winning outcome, the player loses. If the initial non-winning outcome is for example only one symbol position removed from a winning outcome recognized by a paytable or could be a winning outcome if the displayed symbols were in a different orientation, this invention automatically provides a win to the player by merely changing the orientation of these symbols to a winning outcome. The player is then rewarded for this winning outcome. In this way, the player's interest in gaming is retained by rewarding the player by adjusting an outcome that is not contemplated by the paytable into one that is contemplated.

Further, one special symbol is provided which preferably beneficially effects a subset of the total universe of symbols. For example a "wild" bar symbol can match with "non wild" bar symbols, such as a single, double or triple bar.

Moreover, a bonus game appears adjacent the reel game. The bonus game preferably appears as an R(row) by C(column) array correlating colors and numerals to a specific location on the array. Two rotating wheels, located in overlapping relationship, define a sector at their area of mutual overlap which correlates to the array. Filling in the array by successive sector outputs produces bonuses according to a rule set.

OBJECTS OF THE INVENTION

Accordingly, it is a primary object of the present invention to provide a new and novel method and apparatus for rewarding a player whether the player wins or nearly wins an initial game according to both a paytable and a rule set.

A further object is to provide a device and method as characterized above wherein the player is rewarded if the outcome of the initial game can be manipulated according to a rule set to produce a second outcome that is contemplated by the paytable.

A further object to the present invention is to provide a special symbol which effects preferably a subset of the total symbols available.

Another object is to provide a bonus game in which overlapping, rotating wheels dictate completion of an array.

Viewed from a first vantage point, it is an object of the present invention to provide a gaming device, comprising, in combination: a display, a plurality of decision making means, wagering means, a processor including random means operatively coupled to the display, the decision making means and the wagering means to receive and transmit information therebetween, the display including a plurality of symbols oriented in an RXC matrix, the plurality of symbols changing as a function of the wagering means and the random means to provide a first outcome, the processor including a comparison means between the first outcome and a paytable, and including means to change the location of one or more symbols if said first outcome is not recognized by said paytable such that said one or more symbols move from their first outcome orientation to a different area in said RXC matrix to provide a second outcome recognized by said comparison means to be on said paytable.

Viewed from a second vantage point, it is an object of the present invention to provide a method for wagering on a gaming device, comprising the steps of:

making a wager to enable the gaming device, evoking chance means to trigger an outcome, displaying the outcome, comparing the outcome to a paytable, awarding credits if the outcome is found on the paytable, determining whether an outcome found on the paytable can be made by permuting a losing outcome if the losing outcome is not on the paytable, manipulating the losing outcome to produce a winning outcome, and awarding credits for the manipulated outcome found on the paytable.

Viewed from a third vantage point, it is an object of the present invention to provide an apparatus for wagering, comprising, in combination: wagering means, means for displaying a plurality of symbols in an RXC matrix, means for comparing displayed symbols with N paylines to a paytable, means for incrementing an award due in the presence of a winning outcome, means for changing the location of at least one displayed symbol to produce a winning outcome and means for incrementing an award due in the presence of a manipulated outcome that is a winning outcome.

Viewed from a fourth vantage point, it is an object of the present invention to provide a gaming device, comprising in combination: a first display having an RXC matrix upon which a plurality of symbols are selectively exposed and oriented on pay line means, a comparator for assessing exposed said symbols on at least one said payline means, at least one special symbol and a subset of said symbols influenced by said one said special symbol, where said special symbol becomes the equal of any said symbol of said subset when subsequently reoriented on said payline means.

Viewed from a fifth vantage point, it is an object of the present invention to provide a gaming device, comprising in combination: a primary game, a secondary game enabled by an outcome occurring on said primary game, said secondary game including a plurality of overlapping exhibitors means to change said exhibitions such that an area of overlap on said exhibitors defines a bonus element, and an array which registers each element as it appears, said array providing a bonus according to a rule set.

Viewed from a sixth vantage point, it is an object of the present invention to provide a method for gaming, the steps including, defining a subset of bar symbols from a superset of symbols, defining one bar symbol as a wild symbol with respect to only said subset.

Viewed from a seventh vantage point, it is an object of the present invention to provide a method for gaming, the steps including: enabling a plurality of overlapping exhibitors to determine an element, and rewarding the element based on a rule set.

These and other objects will be made manifest when considering the following detailed specification when taken in conjunction with the appended drawing figures.

DESCRIPTION OF PREFERRED EMBODIMENTS

Figure 2:
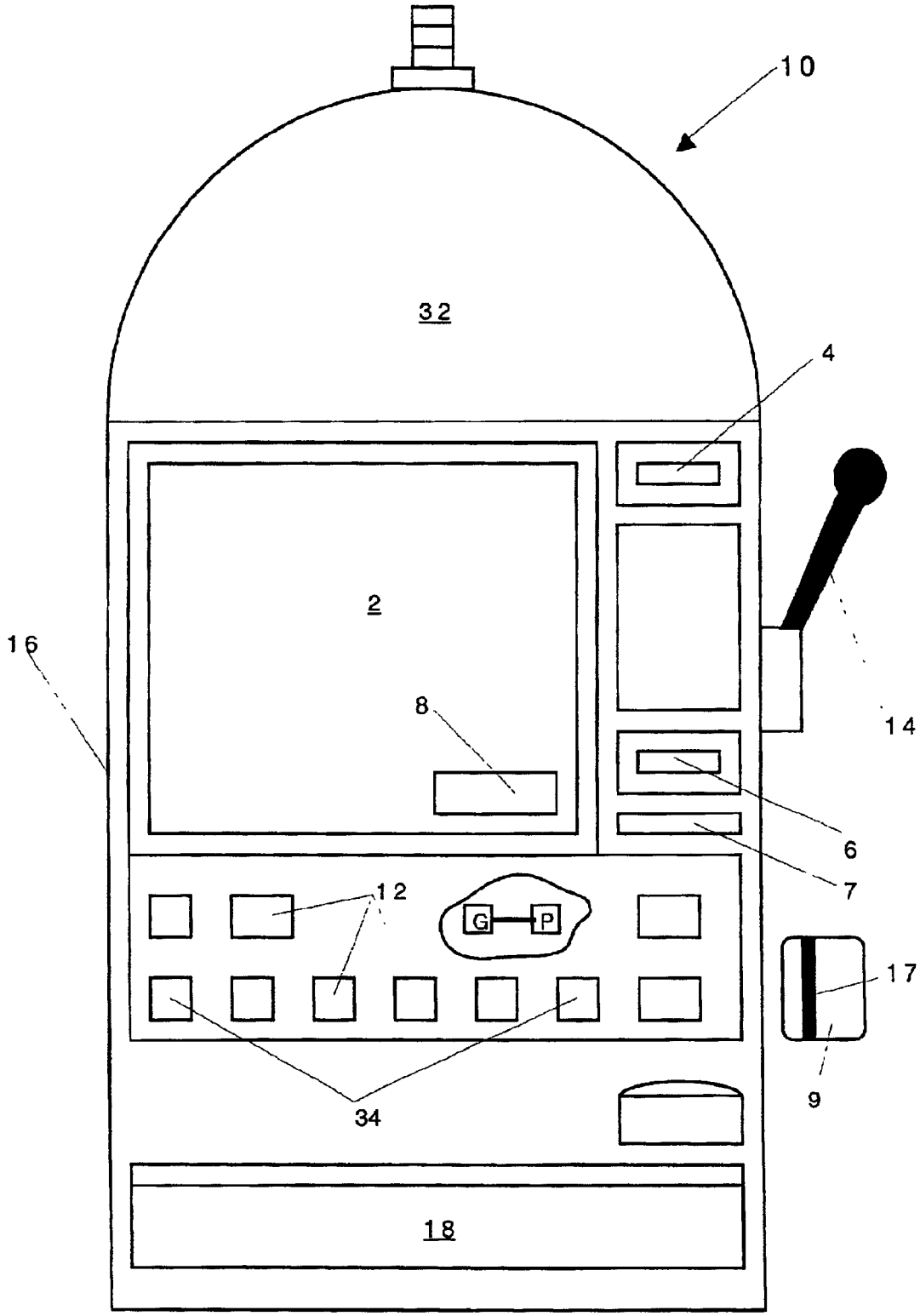
FIG. 2 is a depiction of the apparatus associated therewith.

Considering the drawings, wherein like reference numerals denote like parts throughout the various drawing figures, reference numeral 10 as shown in FIG. 2 is directed to the device according to the present invention.

In its essence, the apparatus 10 includes a housing 16 which supports a visual display 2, preferably a video monitor, therewithin. Alternatively, the device may use a mechanical reel system. The display 2 may include a window 8 for special messages or for incrementing counting of credits accumulated by the player. For example, the window 8 can be used to describe the initiation of the feature of the present invention or its duration, or describe the particular rule set, delineated infra. The device also includes an LED readout 4 for prompting the player and can provide similar verbiage as the window 8 or in lieu thereof, to stimulate the player. The device includes an inlet 6 for the reception therein for coins, currency or the like to auger in the inception of play. A plurality of decision-making buttons 12 are located on the face of the apparatus 10, preferably below the display 2 and a pull handle 14 can be used to initiate play as an alternative to supplement the decision-making buttons 12. A coin hopper 18 may be included to effectuate an output of an award due the player. The apparatus 10 may have a top portion 32 with a display thereon having a motif correlative with the game to be played and can include a paytable. A plurality of speakers 34 may be included on the device for aural interaction with the player. The apparatus also includes a processor P coordinating all functions and a random number generator G operatively coupled thereto for generating outcomes.

Figure 3:
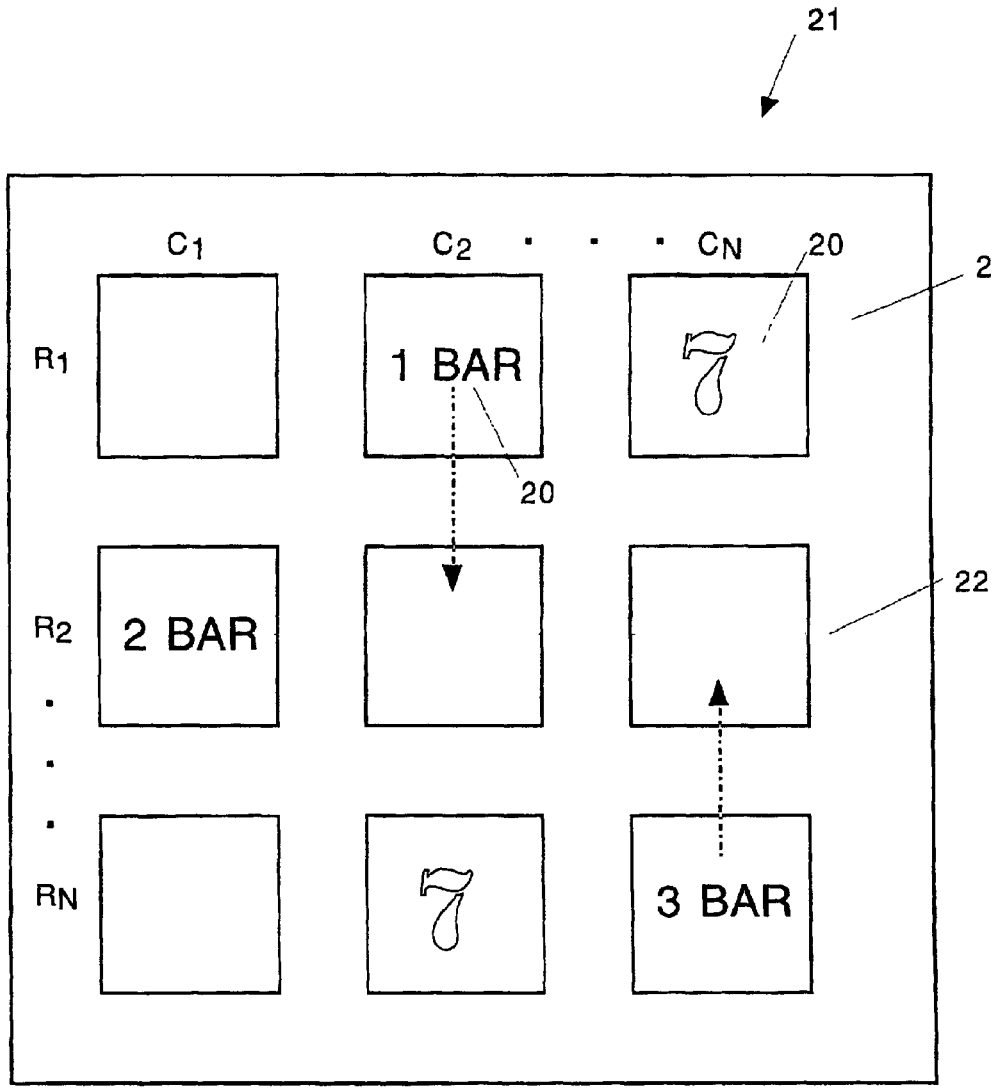
FIG. 3 is a depiction of the display screen shown in FIG. 2, depicting an RXC matrix, having N paylines.

More specifically, and with reference to FIG. 3, greater details with respect to the video display 2 can be explored. The display 2 features a plurality of symbols 20 arranged in a row and column (RXC) matrix 21. Paylines 22 correspond to areas on the matrix in which winning combinations may be located.

Figure 1:
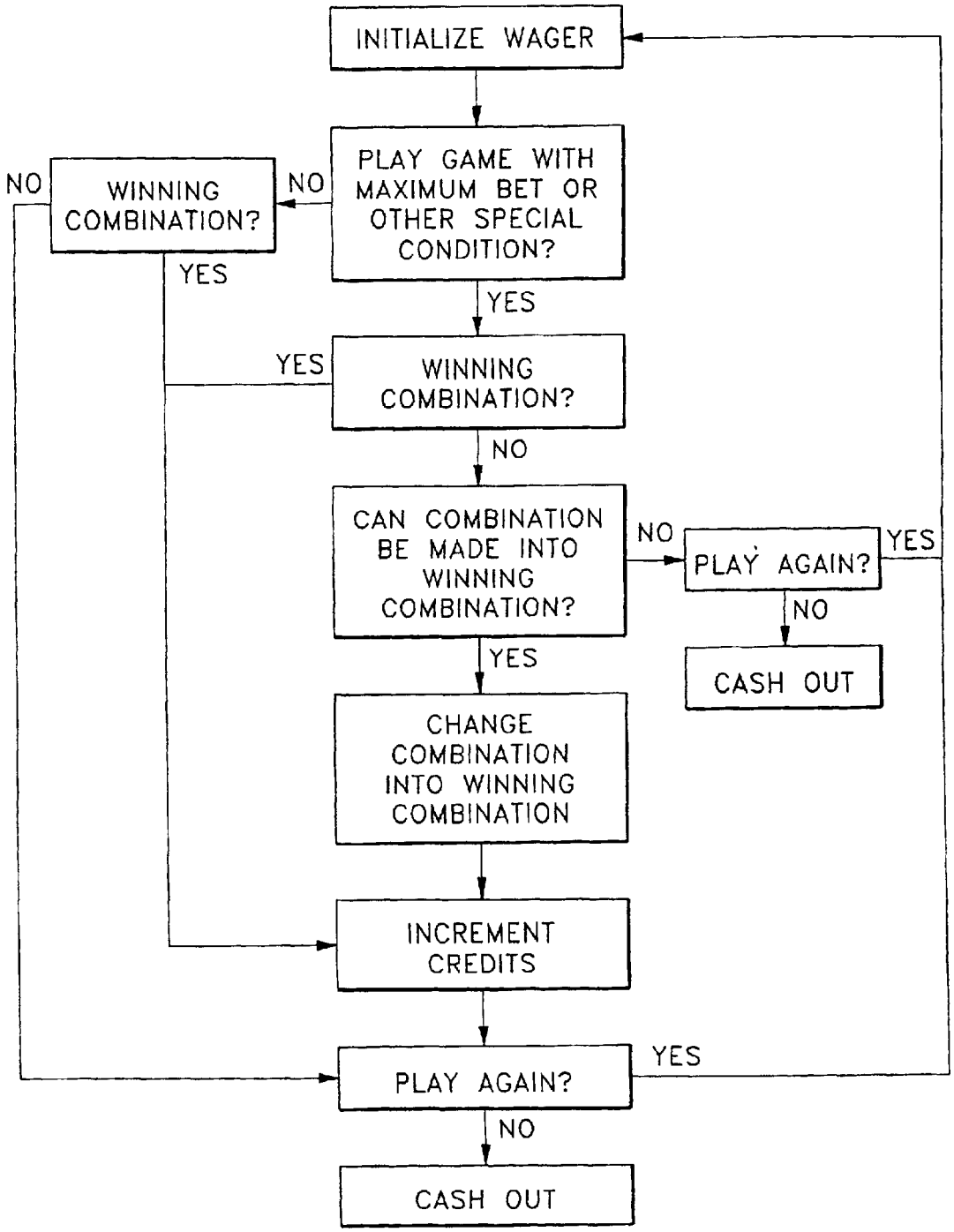
FIG. 1 is a flowchart of the methodology according to the present invention.

Referring to FIG. 1, the flow chart associated with the apparatus of FIGS. 2 and 3 can be explored. Initially, the player plays the game with a maximum bet or less. Preferably, but optionally, a maximum bet enables the features of the invention. Assume a maximum bet is required. If the player plays with less than a maximum bet, the outcome is determined by the symbols displayed according to the display in FIG. 3. If the player opts to play with a maximum bet, then after an initial outcome is displayed, the player is immediately rewarded if the initial outcome corresponds to a value on an associated paytable, and is then given the option to play again or to quit and cash out. However, if the initial outcome does not correspond to a value on the paytable, all of the displayed symbols and their locations are compared to the paytable to determine whether a winning outcome may be produced by reorienting the symbols shown according to a rule set. If no winning combination can be produced from the displayed symbols, the player loses, and is given the option to play again or to quit and cash out. Should a winning combination be possible, the initial outcome is automatically manipulated to produce this winning combination by automatically moving one or more displayed symbols to correspond to the winning combination. The player is then rewarded, according to the paytable, for the winning outcome that was produced.

The following rule set controls potential reorientation when the initial outcome does not correspond to the paytable. Some of the following rules in the rule set may be mutually exclusive.

Figure 4:
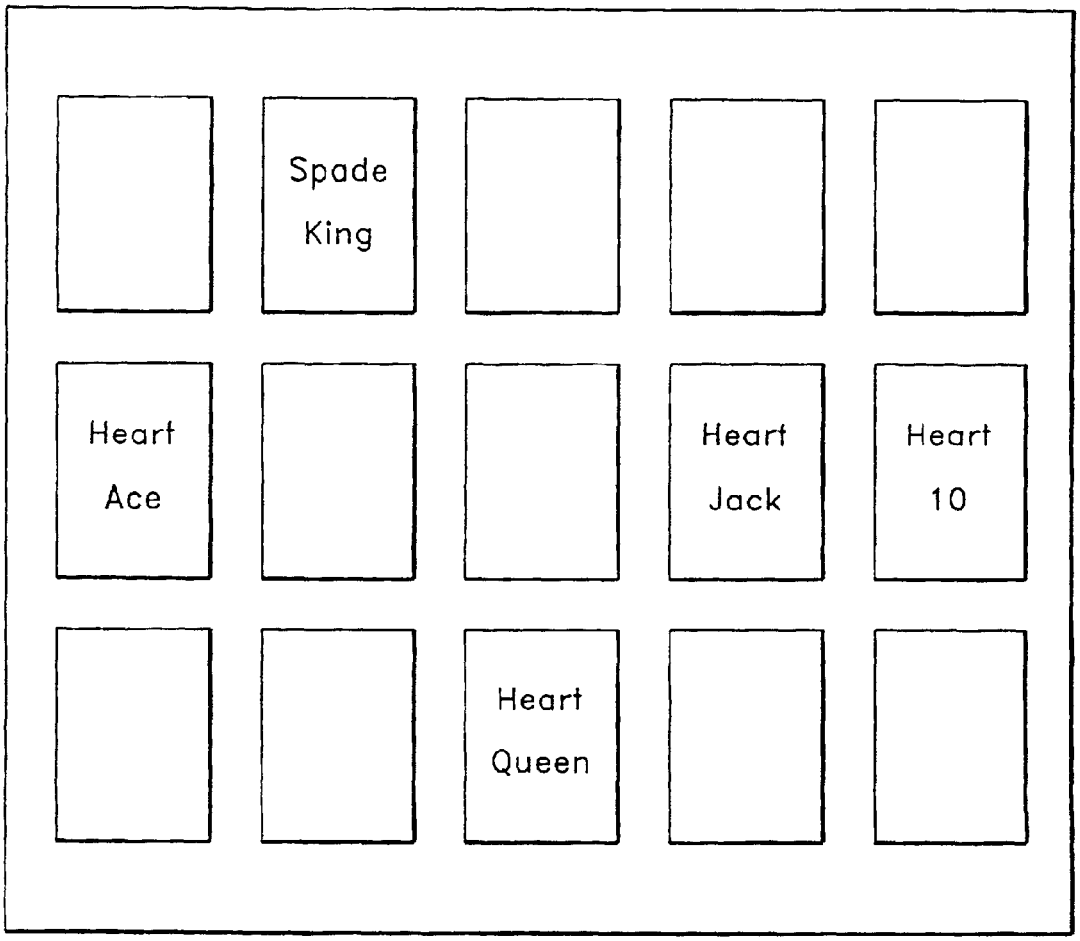
FIG. 4 parallels FIG. 3, illustrating a card game.

1. Symbols may move one stop in either direction in a column.
2. Symbols may only move one stop from a single particular reel to establish winners. For instance, only reel three from a three reel machine may be allowed to move one stop to establish an outcome recognized by the paytable.
3. Symbols may only move one stop from a single reel to establish winners, but the symbol is not limited to a particular reel. For instance, two of the three winning symbols may be on reels two and three, and reel one moves one stop to establish an outcome recognized by the paytable.
4. Symbols may move one stop from multiple reels to establish winners, but not all reels. For instance, a five reel game may only allow moves on reels four and five.
5. All symbols may move one stop to establish an outcome recognized by the paytable.
6. A subset of symbols may move to complete an outcome recognized by the paytable. For example, only cards less than a ten may move in a five reel video poker machine.
7. Symbols may indicate a move direction (up or down) or symbols may move both directions.
8. A move can be based on precedence. For example, the highest winning combination recognized by the paytable may be used, the lowest winning combination may be used, or a bonus event combination of symbols might be used.
9. Symbols may move only during special events. Special events resulting in this invention may include, but are not limited to: time intervals whose occurrence and duration may vary (e.g., happy hour), a special symbol which triggers the invention on subsequent spins, system generated events, player card events, or random events. The special event times may or may not be indicated on the game with a light or other means.
10. These features may be applied to any number of reels or rows. For instance, a five reel, three row game could be used, or a six reel, four row game could be used.
11. These features may be applied to multiline games.
12. These features may be applied to video poker. For example, cards can move from row to row to establish the best possible winners, or cards may change rank or suit to provide a winning hand. For example, FIG. 4 shows an arrangement where a King and a Queen will move to a central row, providing a winning hand. As shown, the new hand yields a straight and a four card flush. In one embodiment (e.g. a maximum bet), if the spade King could transform to any heart, a flush would result. If the spade King transforms to a heart King, a royal flush would result.
13. These features may be applied to table card games. For example, cards can move from row to row to establish the best possible winners, or cards may change rank or suit to provide a sinning hand.
14. These features may be applied to video slot machines. In addition, the symbols do not have to be in different columns, the symbols can "shuffle" to establish winners.
15. These features may be applied to dice games. For example, one die (or more) can be rotated beyond an initial at rest position.
16. Dice can also move from row to row to establish the best possible winners.

Figure 5:
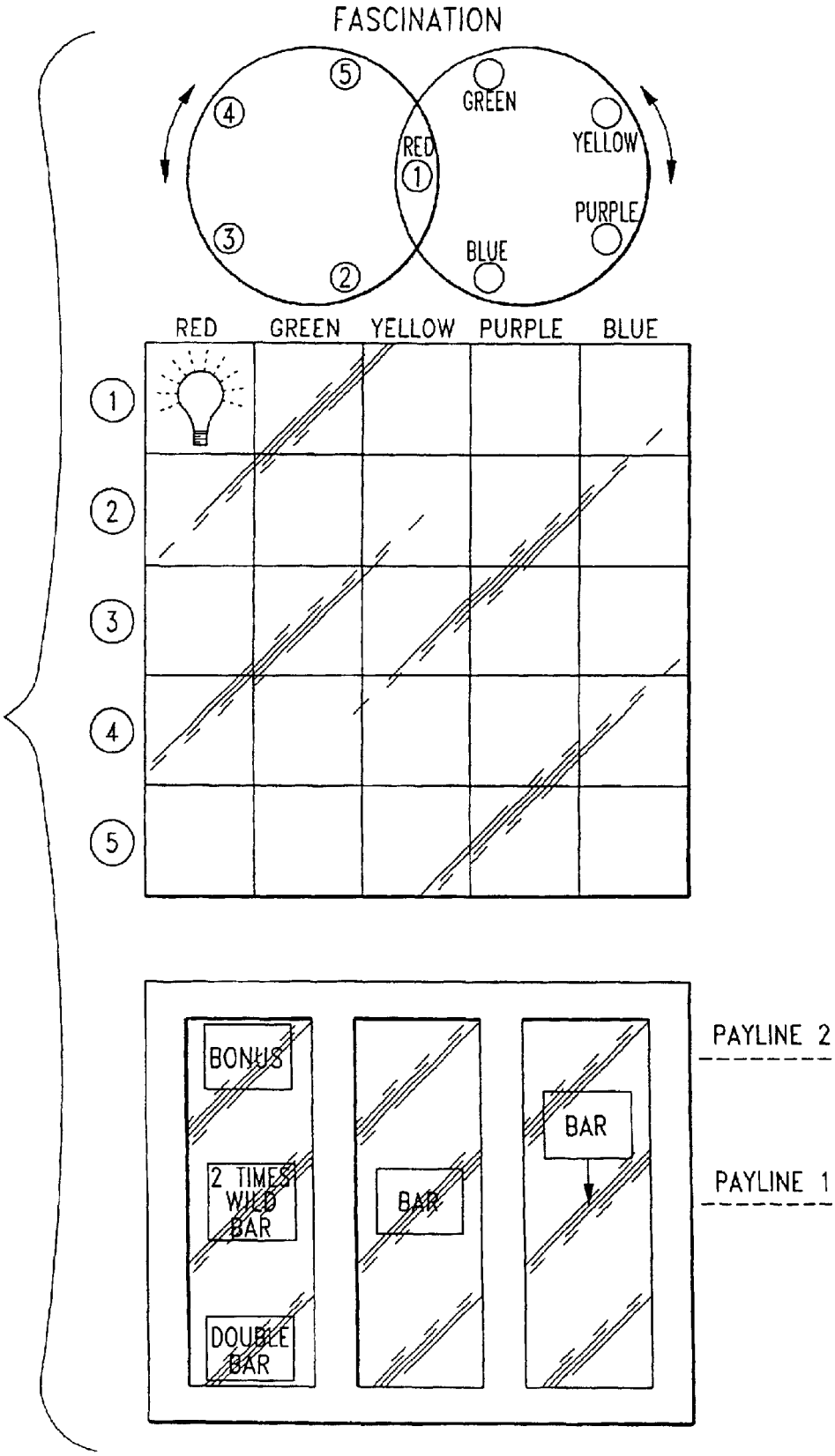
FIG. 5 depicts another display screen and bonus arrangement.
Figure 6:
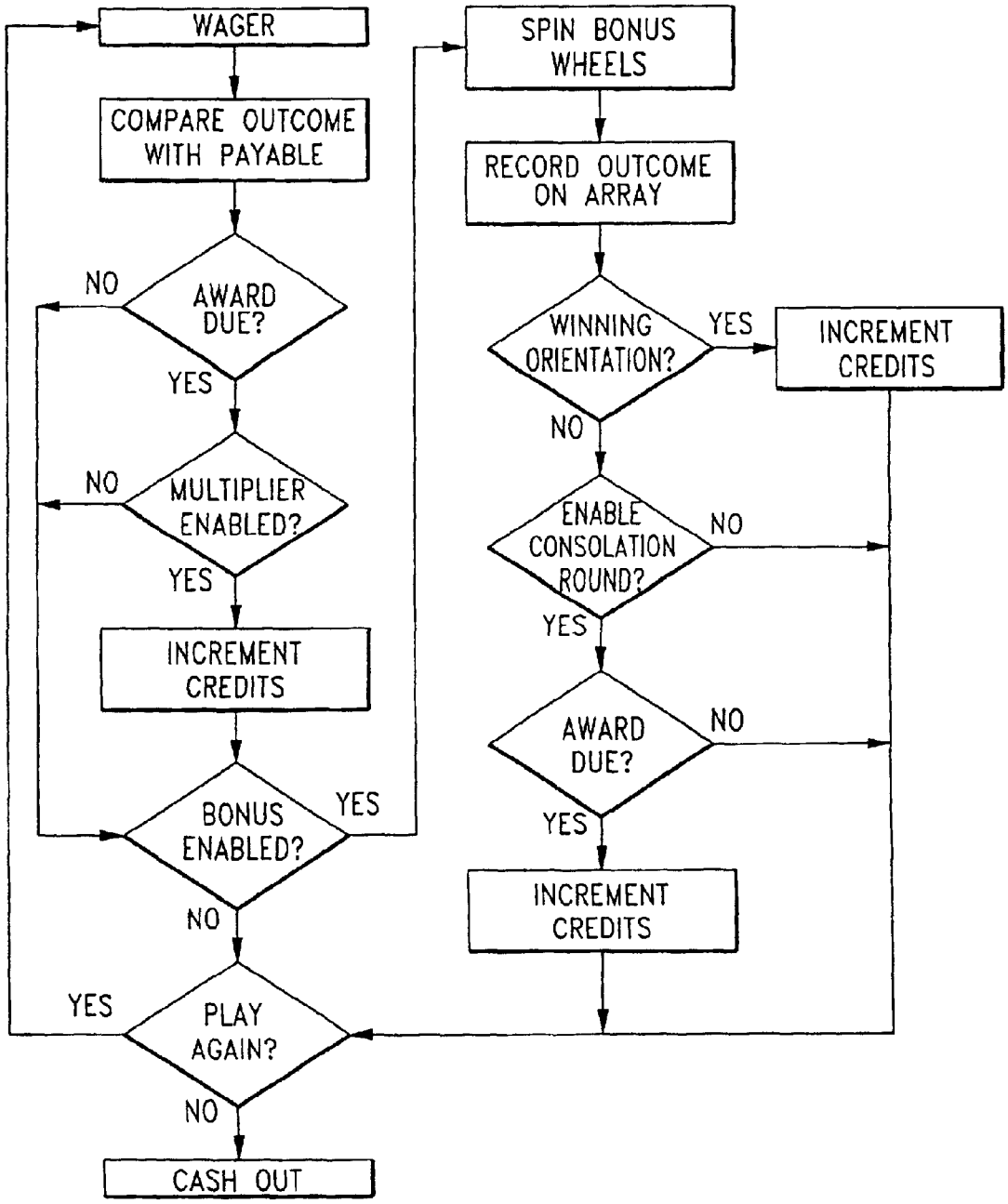
FIG. 6 depicts another flowchart.

FIGS. 5 and 6 illustrate further options. In FIG. 5 a "wild bar" symbol can allow other "bar symbols" to effectuate an outcome found on the payable. By way of background, "bar" symbols are a subset of the universe of symbols which include cherries, plums, other fruit, numerals, cards etc. Bars include single bars; double bars, triple bars etc. A wild bar is recognized as any bar which results in a payout. In FIG. 5 a bar on the right hand reel would move down as with the invention of FIGS. 1-4 to yield a three bar, winning alignment in conjunction with the 2 times wild bar and another bar.

Notice also the bonus symbol of FIG. 5. If a bonus is enabled, the top portion of FIG. 5 is engaged. A 5 by 5 array is shown, however, other collections of elements having other contours are contemplated: such as a pie chart, "hangman", a thermometer (linear array), segmented triangle or other geometric shapes, other body elements or a cloud, etc. can be employed. In other words, completion of a picture, puzzle, a task or progress along a pathway is contemplated. Thus, the array is defined as a completed "project" pending filling in or progression of a goal. The vertical axis on the left hand side delineates a numerical progression for example: 1 through 5. The horizontal axis denotes a series of colors: for example red, green, yellow, purple and blue. Two rotatable wheels are located above the array in overlapping relationship such that one sector (in the example "red"), is in the overlapping sector. Other combinations can occur based on rotation of the wheels as indicated by the arrows. As numbers and colors register in the sector, they are transferred to the array, as by illumination. FIG. 5 shows "red 1" illuminated.

The object of the bonus round is to illuminate a pattern of the array: such as a row, column, diagonal, four corners, the entire array, etc. The more demanding the pattern to be filled, the greater the bonus award. One or more lights in the array may be enabled by wheel spin(s) per bonus round.

Assume, instead, a player, having filled less than the required pattern has to retire from the game. The player can initiate a bonus "consolation" cash out for a nominal payout or can download the game status on a magnetic strip of a "smart" card 9 with a read/write instrumentality 17 lodged in read/write station 7.

Moreover, having thus described the invention, it should be apparent that numerous structural modifications and adaptations may be resorted to without departing from the scope and fair meaning of the instant invention as set forth hereinabove and as described hereinbelow by the claims.

We claim:

1. A gaming device, comprising in combination:

a primary game, a secondary game enabled by an outcome occurring on said primary game, said secondary game including a plurality of overlapping exhibitors, means to change said exhibitors such that an area of overlap on said exhibitors defines a bonus element, and an array which registers each bonus element as each bonus element appears, said array providing a bonus according to a rule set.

2. The device of claim 1 wherein said overlapping exhibitors comprise plural discs, having a common area of overlap with one another, each said disc has a facet of said bonus element, such that said facets collectively define said bonus element.

3. The device of claim 2 wherein said array records said bonus elements as a function of each said facet.

4. A gaming device, comprising, in combination:

a plurality of independent exhibitors having an area of coincidence;

means to repeatedly engage each of said plurality of exhibitors to produce an output in said area of coincidence;

a playfield having positions that correspond to said outputs, wherein said outputs are designated on said playfield; and means to compare said outputs, only as said outputs are designated on said playfield, to a rule set.

5. A method for gaming, the steps including:

providing a primary game; and providing a secondary game, said secondary game independent of said primary game, and said secondary game enabled by an outcome from said primary game and including the steps of:

providing a plurality of independent, changeable exhibitors, said plurality of changeable exhibitors having an area of coincidence, wherein values in said area of coincidence define indicia, transferring said indicia to a playfield, said playfield having positions that correspond to said indicia, rewarding a player only for said transferred indicia on said playfield according to a rule set.

6. A method of gaming, the steps including:

generating single indicia from a plurality of independent changeable exhibitors having an area of coincidence, wherein said indicia represents a combination of values present on said plurality of independent changeable exhibitors in said area of coincidence;

transferring said indicia to a playfield;

repeating the generating step a plurality of times; and comparing said playfield according to a rule set.

7. A gaming device, comprising, in combination:

a playfield, said playfield configured as an array having a plurality of axes;

a plurality of independent changeable exhibitors having an area of coincidence, each said exhibitor representing values present on a different axis, wherein a one-to-one correspondence exists between said axes and said changeable exhibitors;

transfer means to transfer values in said area of coincidence to corresponding positions on said playfield;

award means to award a player based on a rule set.

* * * * *